United States Patent [19]

Foley

[11] Patent Number: 4,535,988

[45] Date of Patent: Aug. 20, 1985

[54] FOOTBALL GOAL POST WITH EXPLOSIVE-TYPE SOUVENIR PROJECTOR

[76] Inventor: Norman G. Foley, Rte. I, Box 30, Matoaka, W. Va. 24736

[21] Appl. No.: 412,524

[22] Filed: Aug. 26, 1982

[51] Int. Cl.[3] ..... A63B 67/00

[52] U.S. Cl. ..... 273/55 D

[58] Field of Search ..... 124/56, 57, 72, 77, 124/42, 70, 71; 273/55 D; 102/325, 318, 351, 352, 326, 327, 328, 340, 202, 357, 332

[56] References Cited

U.S. PATENT DOCUMENTS

| | | | |
|---|---|---|---|
| 950,956 | 3/1910 | Reed | 102/357 |
| 1,324,092 | 12/1919 | Worswick | 102/357 |
| 2,993,694 | 7/1961 | Foley | 273/55 D |
| 3,110,846 | 11/1963 | Wedwick | 102/326 |
| 3,382,724 | 1/1974 | Rottman et al. | 273/55 D |
| 3,500,714 | 3/1970 | Cullinane | 124/42 |
| 3,596,599 | 8/1971 | Schillreff | 102/357 |
| 3,872,870 | 2/1959 | Gey | 102/202 |

*Primary Examiner*—Richard C. Pinkham
*Assistant Examiner*—T. Brown
*Attorney, Agent, or Firm*—Harvey B. Jacobson

[57] ABSTRACT

A football goal post assembly of standard dimensions in which one or both vertical posts are of hollow construction for receiving a plurality of disc-type souvenirs that are ejected from the upper end of the hollow post by an explosive-type projector arrangement so that upon actuation, the souvenirs will be discharged vertically at a relatively high velocity for distribution over a large area of a football stadium.

1 Claim, 4 Drawing Figures

FOOTBALL GOAL POST WITH EXPLOSIVE-TYPE SOUVENIR PROJECTOR

BACKGROUND OF THE INVENTION

1. Field of the Invention

The present invention generally relates to football goal posts and more particularly to such a goal post having an explosivetype souvenir projector incorporated therein for ejecting a plurality of disc-type souvenirs into the air so that they will fall into a widely distributed pattern in a football stadium so that persons attending a football game or similar event will be provided with a souvenir of that event.

2. Description of the Prior Art

My prior U.S. Pat. No. 2,993,694 issued July 25, 1961 discloses a mechanical type of souvenir projector associated with football goal posts. The structure disclosed in that patent is a compressed spring arrangement to eject the souvenirs and a rotating mechanism to spin or rotate the discs as they are ejected from the football post so that the souvenir discs sail to various areas of the football stadium.

SUMMARY OF THE INVENTION

An object of the present invention is to provide a football goal post with a souvenir projector incorporated therein in which the souvenirs are in the form of generally circular flat discs which are oriented in a stacked relationship internally of a tubular goal post with the disc being ejected by an expanding gas such as produced by an explosive charge, compressed air or the like.

Another object of the invention is to provide a football goal post with souvenir projector in accordance with the preceding objects in which the goal posts have conventional external appearance characteristics and which have incorporated therein a souvenir projector utilizing a chamber receiving an explosive charge with a detonating cap or other provisions being made for detonating the explosive charge for ejecting all of the souvenir discs at a relatively high velocity so that the discs will float and sail over a relatively large area such as the interior portions of the football stadium and the like to provide a souvenir to the fans attending a football game thereby reducing the tendency of enthusiastic fans to take home a souvenir which sometimes includes a portion of the stadium, goal post or the like.

A further object of the invention is to provide a souvenir projector incorporated into football goal posts which are of standard dimensions as required by various organizations which formulate the rules of play of football games and includes a safe, dependable and long lasting explosive-type souvenir projector.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
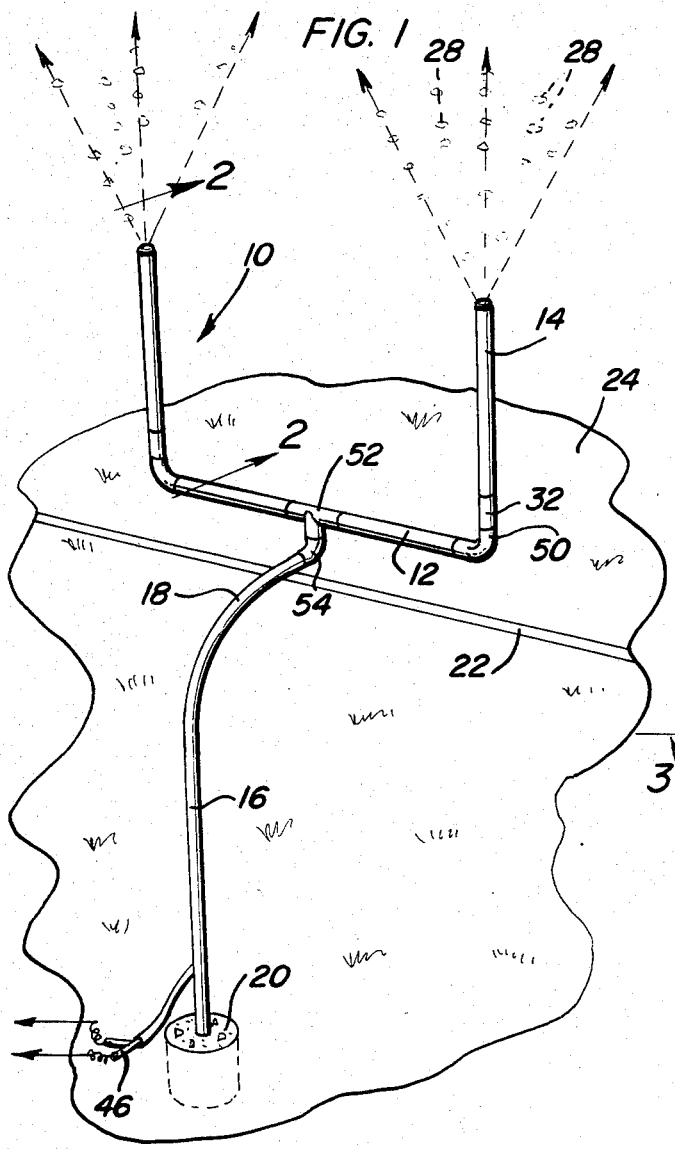
FIG. 1 is a perspective view of a football goal post with the souvenir projector of the present invention incorporated therein with the dispersion pattern of the souvenir disc being schematically illustrated.

Referring now specifically to the drawings, the football goal post of the present invention is generally designated by the reference numeral 10 and includes a horizontally disposed cross bar 12 having an upstanding goal post 14 at each end thereof with the goal posts 14 being parallel to each other and perpendicular to the cross bar 12 and oriented so that the goal posts 14 are properly spaced apart and have the proper height as required to play football. The goal posts 14 are supported by a single centrally disposed supporting post 16 having an offset upper end portion 18 joined to the center of the cross bar 12 with the lower end of the supporting post 18 being inserted into a concrete base 20 or other suitable supporting structure with the goal post 14 and the cross bar 12 being properly oriented in relation to the goal line or end zone end line 22 of a playing field 24 so that the goal post and the cross bar 12 are properly oriented in relation to the playing field 24.

Figure 2:
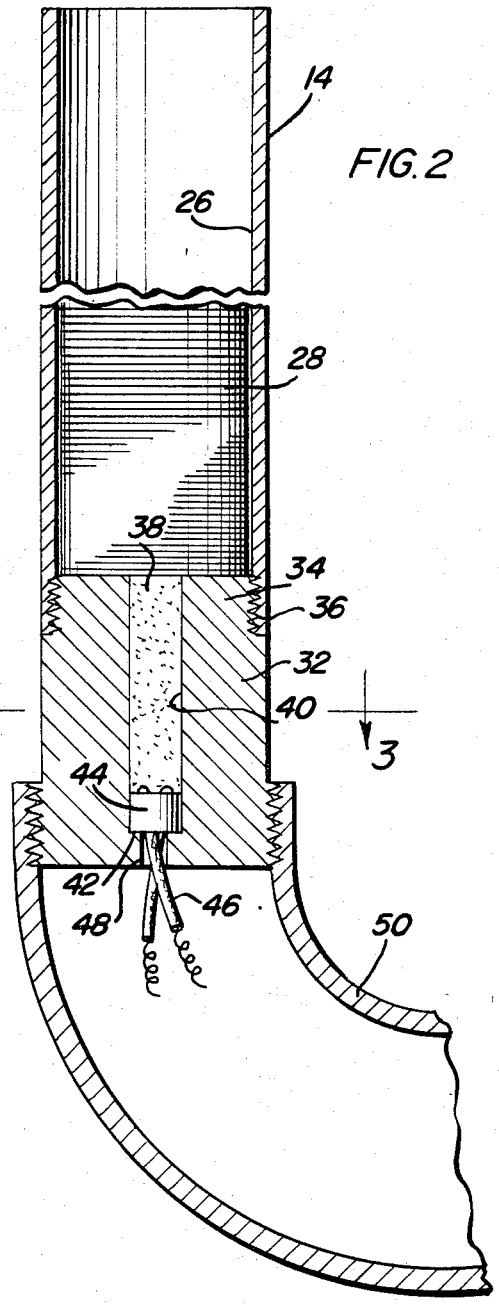
FIG. 2 is a vertical sectional view, on an enlarged scale, taken substantially upon a plane passing along section line 2—2 of FIG. 1 illustrating the construction of the souvenir projector.
Figure 3:
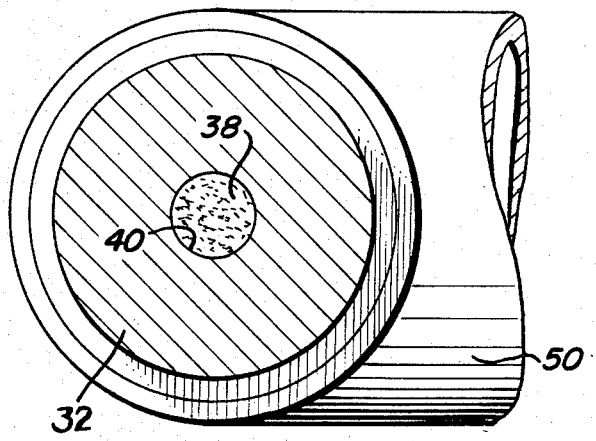
FIG. 3 is a transverse, sectional view taken substantially upon a plane passing along section line 3—3 of FIG. 2 illustrating further structural details of the souvenir projector.
Figure 4:
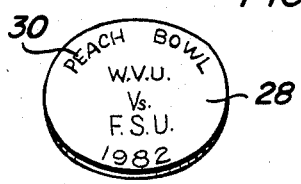
FIG. 4 is a perspective view of one of the souvenirs used in the souvenir projector.

As illustrated in FIG. 2, each goal post 14 is in the form of a tubular pipe having a straight hollow interior 26 adapted to receive a stack of substantially flat circular discs 28 as illustrated in FIG. 4 with each disc 28 having indicia 30 printed or otherwise formed thereon to provide a souvenir of a particular football game including the opponents, date, location and the souvenirs may have the school colors or other indicia incorporated thereon. The discs 28 are so constructed that when they are projected from the open upper end of the goal post 14, they will be dispersed over a relatively large area due to the fact that the discs will tend to sail, float and otherwise separate and provide readily available souvenirs to the fans at the end of a football game. At the lower end of the goal post 14, a cylindrical member 32 is provided which has a diameter substantially the same as the diameter of the post 14 and has a reduced upper end portion 34 screw threadedly engaged with the internally threaded lower end portion of the goal post 14 as at 36. The member 32 is of solid metal construction and forms a breech block for an explosive charge 38 positioned in a central cavity 40 which has a shoulder 42 at its lower end on which a firing cap 44 or the like is provided with the firing cap including wires 46 connected thereto and extending down through a smaller passageway 48 in the lower end of the member 32. The lower end of the member 32 is also screw threaded into a tubular member 50 in the form of a pipe elbow which connects the lower end of the goal post 14 to the cross bar 12 which is also of tubular pipe construction having a central T-connection 52 joined to an elbow 54 at the upper end of the supporting post 16 so that standard tubular pipe members may be employed in constructing the supporting post 16, the cross bar 12 and the goal posts 14 with the cylindrical member 32 being the only part which is specifcally constructed with this component being provided with sufficient strength characteristics to safely withstand the pressures formed by the explosive charge 38 when it is detonated by the cap 44. The wires 46 may extend through the tubular cross bar, down the supporting posts 16 and out near the lower end thereof for connecting to a suitable power source and switch (not shown) so that the explosive charge 38 can be detonated when desired. Alternatively, the explosive charge 38 may be detonated remotely by a suitable transmitterreceiver assembly so that the souvenir discs may be projected from a remote location by actuating the transmitter. Various arrangements may be provided for detonating the explosive charge 38 which may be in the form of a pre-formed cartridge having a detonating cap incorporated therein with the detonating cap having contacts which will engage a set of stationary contacts incorporated into the lower end of the cavity 40. As a further alternative, a source of compressed air may be connected to the lower end of the goal post 14 and suitable valve structure provided for introducing a large volume of high pressure air into the lower end of the goal post 14 under the disc-like souvenirs 28 so that the souvenirs may be easily and rapidly projected from the upper end of the pipe 14. In this construction, the member 32 may have a suitable passageway therein connected to a source of compressed air which may be in the form of the supporting post 16, cross bar 12 and pipe fitting joined therewith all of which will be constructed so that they will retain the air pressure which is introduced against the under surface of the souvenirs 28 to eject them from the upper end of the goal post 14.

The number of souvenirs provided in each tubular goal post 14 may be varied with the maximum number completely filling the goal post 14 and the explosive charge 38 may be varied depending upon the number of souvenirs to be ejected and the size of the stadium involved with more souvenirs being ejected when a large stadium is completely filled with spectators. The explosive charge 38 whether it be a separate cap and preformed explosive powder or a cartridge type arrangement may be inserted into the cavity 40 from the upper end of the tubular goal post 14 or the lower end portion of the goal post 14 adjacent its attachment to the cylindrical member 32 may be provided with an access door which is hingedly or otherwise removable and secured by suitable clamp or latch structure that provides access to the cavity 40 for insertion of the explosive charge into the cavity 40. The disc 28 may be relatively light weight and thin so that a large number of discs may be stacked in the goal post and so that as they are projected from the upper end thereof, they will separate, become dispersed and spread over a large area of the stadium so that fans in various areas of the stadium may have a reasonable chance of obtaining one of the souvenir discs rather than seeking a souvenir of the event such as a portion of the goal post which sometimes are torn down after a football game or a portion of the stadium seats, turf or the like which is an additional expense to the upkeep of the stadium and sometimes results in injuries to the participants when goal posts are torn down. The souvenir projector of the present invention provides an efficient, simple and low cost souvenir to those spectators who want to carry home a souvenir of a particular football game or the like. While the structure has been specifically related to football goal posts and football games, the same concept may be incorporated into other goal assemblies or the like for ejecting souvenir discs for various spectator events.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a football goal post comprising a horizontal cross bar and a pair of vertically disposed tubular members of equal length oriented at the ends of the cross bar, said cross bar and tubular members being constructed of tubular pipe and a pipe fitting interconnecting the cross bar and the vertical tubular members, that improvement comprising a substantially solid breech block inserted between the lower end of at least one tubular member and the pipe fitting with the breech block being screw-threadedly connected to the pipe fitting and the lower end of the tubular member thereby becoming a part of the football goal post, said breech block including a cavity communicating with the upper end thereof receiving an explosive charge for detonation and discharging expanding gases and products of combustion into the lower end of the tubular member, a plurality of thin, substantially flat, imperforate, lightweight discs oriented in a vertical stacked independent relation in the tubular member with the lowest disc supported against the upper end of the breech block whereby detonation of the explosive charge in the breech block will eject the stack of discs upwardly and out the upper end of the tubular member without rotation for discharge of the discs in a random pattern over a relatively large area around the goal post, said tubular member being in the form of a pipe having a generally circular cross-sectional configuration with the discs closely but loosely fitting the interior of the tubular member for ejection of the discs at a relatively high velocity for dispersal over a large area to provide many spectators at a football game with the opportunity to obtain one of the discs, said discs including indicia relating to a football game, said breech block having an external periphery similar to the external periphery of the tubular member.

* * * * *